United States Patent [19]

Bradley et al.

[11] 4,181,989

[45] Jan. 8, 1980

[54] MATTRESS ELEVATING DEVICE

[76] Inventors: John J. Bradley; Frances L. Bradley, both of 2000 Fairfield Dr., Wilmington, Del. 19810

[21] Appl. No.: 875,732

[22] Filed: Feb. 6, 1978

[51] Int. Cl.[2] ..... A47C 21/08

[52] U.S. Cl. ..... 5/509; 5/437; 5/443

[58] Field of Search ..... 5/74–79, 5/317 R, 327 R, 327 B, 329, 92; 312/140, 140.3

[56] References Cited

U.S. PATENT DOCUMENTS

| | | | |
|---|---|---|---|
| 2,724,627 | 11/1955 | Moncier | 312/140.3 |
| 3,021,533 | 2/1962 | Emery | 5/327 R |
| 3,087,170 | 4/1963 | Emery | 5/327 R |
| 3,413,772 | 12/1968 | McCarthy | 312/140 |
| 3,452,372 | 7/1969 | Emery | 5/327 R |

*Primary Examiner*—Casmir A. Nunberg
*Attorney, Agent, or Firm*—Clinton F. Miller

[57] ABSTRACT

A mattress elevating device is composed of components easily and quickly assembled and disassembled without the use of tools, the components being suitably sized for packing and transporting in a suitcase. The components comprise a pair of panel members releasably secured together to form a substantially flat mattress supporting surface and elevating means releasably mounted on the bottom of one of said members for holding the panels in an upwardly inclined raised position. The panel members are substantially rectangular in shape and of the same size and are arranged with adjacent edge portions thereof in overlapping relationship. Bolts and wing nuts are used to releasably secure the panel members together and a cross member is attached to the bottom of the top panel member and forms therewith an elongated groove for receiving the underlying edge of the other panel member and preventing movement thereof away from the bottom of the top panel member. The elevating means comprise a member extending across the bottom of the top panel member and having spaced slots therein for slidably receiving the base portions of clips, said base portions of the clips having spaced arms extending downwardly from the bottom of the panel member. A substantially rectangular strip of plywood or the like is slidable between the arms of the clips and has a suitable width to provide the desired elevation of the panel members. The device is readily disassembled by slidably removing the strip and the clips, loosening the wing nuts and pulling the panel members apart.

9 Claims, 7 Drawing Figures

MATTRESS ELEVATING DEVICE

This invention relates to a device insertable between the head or foot portions of a bed matress and a box spring for holding the mattress in a raised position.

Some forms of physical disabilities such as emphysema and other respiratory diseases, hiatal hernia, circulatory impairments and the like, make it highly desirable, if not necessary, that persons having such disabilities rest and/or sleep with their heads or feet in an elevated position. Such persons can be accommodated readily in a hospital since hospital beds are provided with manually or electrically operated mechanisms by which the head or foot portion of the bed can be adjusted upwardly to any desired position. However, beds in the home and in hotels and motels generally are not equipped in this manner, and hence an elevating device of some kind, placed between the mattress and the box spring, is required to accomplish this result.

One device of this type, shown and described in U.S. Pat. No. 3,021,533, consists of a supporting member having a relatively flat mattress supporting top and means hingedly connected thereto and adapted to be turned downwardly to raise the supporting member to an upwardly inclined or raised position. The supporting member is creased along a centrally located line running from front to rear thereof and can be folded upon itself along such line when not in use. While this patented device may be suitable for use around the home, it is much too large, even when folded, as well as heavy and bulky, to be carried in a suitcase while traveling. Hence, if taken on a trip, it would have to be carried as a separate piece of luggage which would be inconvenient and expensive.

A principal object of the invention is the provision of a mattress elevating device consisting of relatively small and light components which can be assembled and disassembled easily and quickly without the use of tools and which, when disassembled, can be packed in a conventional suitcase thereby enabling a person, who must rest and/or sleep with the head in an elevated position, to travel comfortably with the assurance that he has the means for quickly and easily modifying a bed for suitable head elevation.

A further object of the invention is the provision of a device of the indicated type which is sanitary, simple and economical to manufacture, light in weight, and sized and shaped to permit easily handling thereof when it is placed in, or removed from, operative position.

In accordance with the invention there is provided a mattress elevating device composed of components easily and quickly assembled and disassembled without the use of tools, said components being suitably sized to be packed and transported in a suitcase, said device comprising panel members arranged with adjacent edge portions thereof in overlapping relationship to provide a substantially flat upper mattress supporting surface, means releasably securing the panel members together in said overlapping relationship, means secured to one of said panel members for preventing movement of the overlapped portion of the other panel member outwardly away from said one member, and means releasably mounted on the bottom of one of said panel members for supporting one end of the assembled panel members in a raised position.

Having described the invention in its broader aspects it will now be described in more detail with reference to the accompanying drawings wherein.

Figure 1:
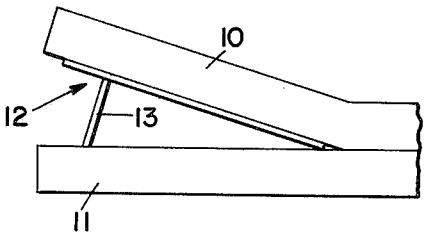
FIG. 1 is a side elevational view of an end portion of a conventional box spring and mattress for a bed showing schematically the device of this invention in operative position to hold the end portion of the mattress in an elevated position with respect to the box spring.

FIG. 1 of the drawing shows a mattress 10 and box spring 11 of a conventional bed, one end of the mattress being supported in the raised position by the device of the invention schematically shown as comprising a mattress supporting member 12 and an elevating member 13.

Figure 2:
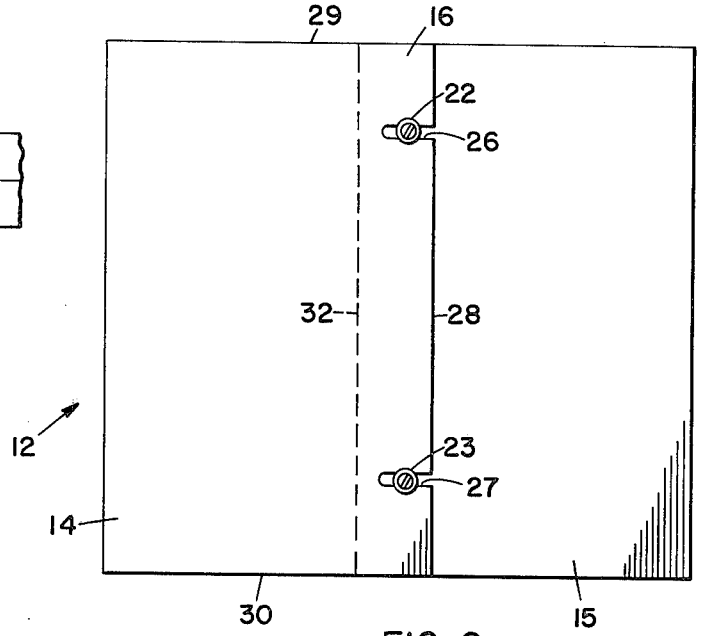
FIG. 2 is a top plan view of the assembled device of the invention.
Figure 3:
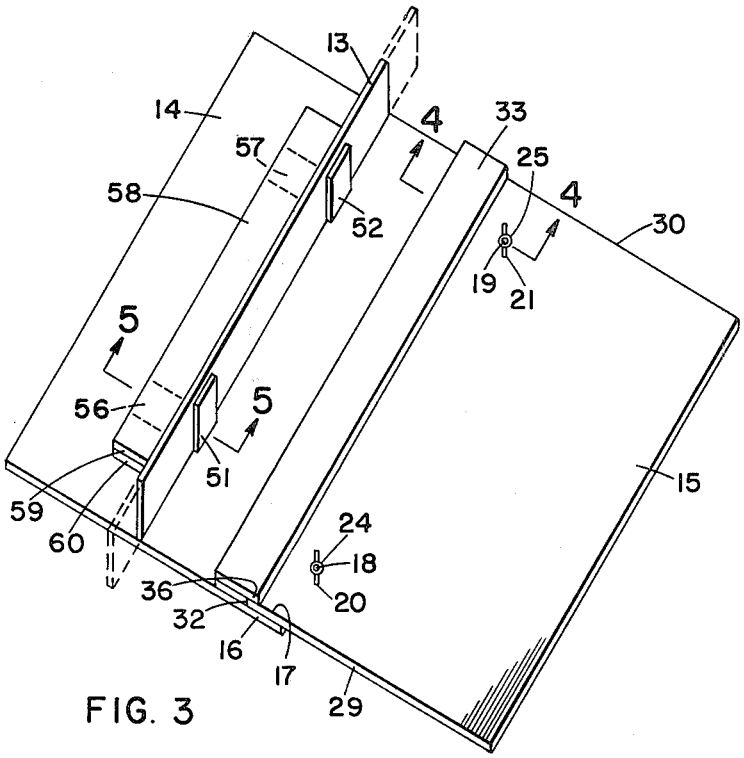
FIG. 3 is a bottom isometric view of the device of the invention.

As shown more clearly in FIGS. 2 and 3, the mattress supporting member 12 is composed of panel members 14 and 15 which are desirably rectangular in shape and of the same size. These members are desirably made of thin sheets of plywood having a high resistance to bending and breaking. While not critical, it has been found that panel members about 24 inches long, about 15 inches wide and about one quarter ($\frac{1}{4}$) inch thick are quite suitable for use herein.

Figure 4:
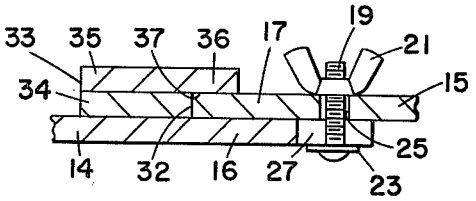
FIG. 4 is an enlarged cross-sectional view of the device of the invention taken on the line 4—4 of FIG. 3.

As shown in FIGS. 2 and 3 and in more detail in FIG. 4, the panel members 14 and 15 are arranged with adjacent edge portions thereof in overlapping relationship, the overlying portion of panel member 14 being denoted by the numeral 16 and the underlying portion of the panel member 15 being denoted by the numeral 17. While the amount of overlapping of the members 14 and 15 may be varied it must, of course, be sufficient to provide the necessary resistance to bending of the assembled panels when secured and held in position as hereinafter described. In the size panels mentioned above the resistance to bending has been found to be quite satisfactory if the amount of overlapping is about three inches.

The panel members 14 and 15 are secured in overlapping relationship by bolts 18 and 19 and wing nuts 20 and 21. Washers 22 and 23, preferably secured to the heads of the bolts in any suitable manner as with adhesives, solder or the like, are desirably provided to increase the area of contact with the upper surface of the panel member 14 on each side of the slots described below. The bolts 18 and 19 pass through openings 24 and 25 in the panel member 15 and through slots 26 and 27 extending inwardly from the edge 28 of the overlying portion 16 of the panel member 14.

The openings 24 and 25 are desirably positioned adjacent the sides 29 and 30 of the assembled panel members 14 and 15 and slightly inwardly with respect to the edge 28 of the overlying portion 16. They are desirably of a size to snugly receive the bolts 18 and 19 and frictionally hold them in positins such that the washers 22 and 23 are spaced from the upper surface of the panel member 15 sufficiently to permit the edge 28 of panel member 14 to be pushed thereunder.

The slots 26 and 27 must extend inwardly enough from the edge 28 of panel member 15 to permit assembly of the panel members with the desired amount of overlap. In the embodiment of the invention shown this is accomplished by making the slots about one and one quarter inches long or approximately one third the amount of overlap. However, the slots 26 and 27 may be made somewhat longer if desired.

When the panel members 14 and 15 are secured in overlapping relationship by the bolts 18 and 19 and the wing nuts 20 and 21, the edge portion 32 of the underlying portion 17 of panel member 15 is held against movement away from the bottom surface of panel member 14 by a member indicated generally by the numeral 33. The member 33 desirably consists of strips 34 and 35 extending across the bottom surface of panel member 14 and secured to each other and to panel member 14 in any suitable manner as by staples, adhesives, screws or the like. The member 34 abuts the edge portion 32 of the panel member 15 and therefore determines the extent of overlap of the panel members.

The member 35 is somewhat wider than the member 34 to provide a projecting portion 36 which underlies the edge portion 32 of the panel member 15 and holds it against movement away from the panel member 14. As will be noted, the members 34 and 35 in conjunction with the overlying portion 16 of the panel member 14 form an elongated groove 37 extending across the panel member 14 adapted to receive the edge portion 32 of the panel member 15.

The member 34 may desirably be made of thin plywood similar to that used for the panel members 14 and 15 and the member 35 of a thinner strip of material e.g. compressed board or the like, having the necessary strength, stiffness and resistance to bending and breaking to hold the edge portion 32 of member 15 against movement away from the surface of panel member 14 when downward force is applied to the assembled panel members during use of the device.

The elevating member 13 desirably consists of a rectangular strip of material such as the plywood used in panel members 14 and 15. The width of member 13 is such as to hold the panel members at the neight to which it is desired to raise the mattress. The length of the elevating member 13 is preferably the same as the width of the supporting member 12 but may be longer so as to extend beyond the edges 29 and 30 of the member 12 as shown in dotted lines in FIG. 3.

Since individual preferences may vary as to the total height to which the mattress 10 is to be raised, a series of strips 13 of different widths (not shown) may be provided to accomodate these individual preferences. Alternatively, differences in height may be obtained by the utilization of an elevating member such as that shown in FIG. 6 wherein two overlapping strips 40 and 41 are provided with series of similarly positioned holes 42, 43, 44, and 45 adapted to receive bolts 46 and 47 provided with wing nuts 48 and 49. By removing bolts 46 and 47 the member 41 can be moved upwardly or downwardly with respect to member 40 until oppositely disposed holes 44 and 45 of member 41 are brought into registry with oppositely disposed holes 42 and 43 in the member 40 to provide the height desired. The bolts 46 and 47 may then be inserted through the registered holes and the wing nuts 48 and 49 applied and tightened to hold the members in the desired position.

Figure 5:
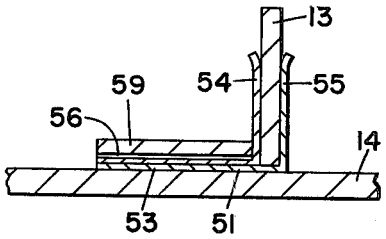
FIG. 5 is an enlarged cross-sectional view of the device of the invention taken on the line 5—5 of FIG. 3.
Figure 6:
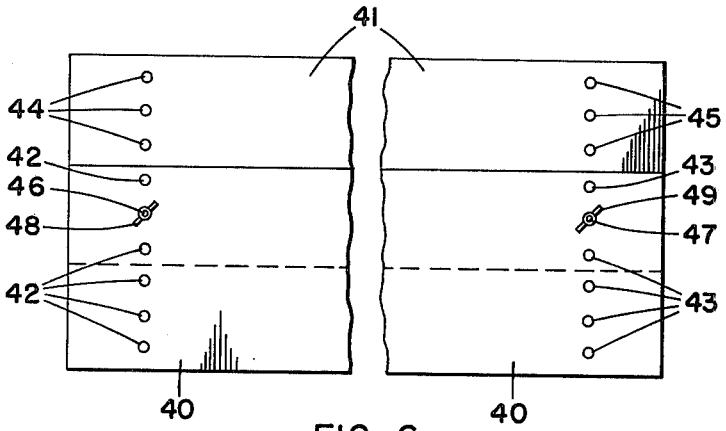
FIG. 6 is a broken front elevational view of a modified form of the elevating member.

As more clearly shown in FIGS. 3 and 5, the elevating member 13, or the modified elevating member shown in FIG. 6, is releasably mounted in clips 51 and 52. Each of the clips 51 and 52 is desirably formed from two flat strips of relatively stiff but resilient metal, portions thereof being secured together as by rivets, welding or the like to form a base portion 53 and each strip beyond the base portion 53 being bent at right angles to form spaced apart arms 54 and 55. The spaced arms 54 and 55 are designed to snugly receive the elevating member 13 and to frictionally hold it in position. The outer ends of the arms 54 and 55 are desirably flared outwardly from each other slightly to facilitate entry of the elevating member therebetween.

The base portions 53 of the clips 51 and 52 are slidably received in slots 56 and 57 (shown in FIG. 5 and by dotted lines in FIG. 3) formed in a cross member 58 secured to the bottom of panel member 14 in any suitable manner as by adhesives, staples, screws or the like. The cross member 58 may consist of a relatively thin strip 59 of compressed board or the like and a member 60 (FIG. 3) positioned between the strip 59 and the under surface of the panel 14. The member 60 is made of thin plywood or the like and desirably comprises three separate pieces spaced apart to form the slots 56 1nd 57. The sizes of the slots 56 and 57 are desirably such as to snugly engage the faces of the base portions 53 of the clips 51 and 52 so that they are frictionally held in place while the assembled device is being placed in or removed from its operative position. If desired, the cross member 58 may be made of a single strip of material with the slots 56 and 57 being formed by cutting out portions thereof in the desired locations.

The device of the invention is easily and quickly assembled without the use of tools in the following manner. The bolts 18 and 19 with wing nuts 20 and 21 are desirably left in the openings 24 and 25 and positioned so that the washers 22 and 23 are spaced from the upper surface of the panel member 15 slightly more than the thickness of the panel member 14. If the bolts 18 and 19 are not so positioned this is first done and then the panel members 14 and 15 are moved into position such that the edge portions 28 and 32 thereof are in overlapping relation with the bolts 18 and 19 disposed opposite the slots 26 and 27. The panel members are then pushed together until the edge portion 32 of the panel member 15 engages the edge of the member 34 thus insuring that the edge portion 32 is properly seated in the groove 37. The wing nuts 20 and 21 are then tightened by hand to secure the panel members together in this position.

With this arrangement the resistance to bending of the panel members at the overlapping portions is principally, if not entirely, a function of the strength and resistance to bending of the panel members and the amount of overlap, the bolts 18 and 19 and wing nuts 20 and 21 primarily serving to detachably secure the panels together. In the arrangement herein shown and described the amount of overlap of the panel members is such as to provide the resistance to bending of the assembly needed in a device of this kind. The above is not intended to convey the impression that a particular amount of overlap is critical since it will vary with many factors including the resistance to bending of the panel members, the amount of force applied to the surface of the assembled panel members during use of the device and so on.

With the panel members secured together as above described the assembly of the device is easily and quickly completed by inserting the base portion 53 of each of the clips 51 and 52 into the grooves 56 and 57 of the member 58 and then inserting and pressing the elevating member 13 into and between the arms 54 and 55 of the clips 51 and 52. While the arms 54 and 55 of each of the clips 51 and 52 have sufficient resiliency to grip the elevating member 13 firmly they are nonetheless sufficiently strong, rigid and resistant to bending to hold the elevating member in a position substantially perpendicular to the bottom surface of panel member 14 when the device of the invention is utilized for its intended purpose.

The assembled device is light in weight and is easily placed in operative position by raising an end of a bed mattress and placing the device between the raised end of the mattress and the box spring.

The assembled device is readily taken apart without tools by (1) removing the elevating member 13 from the clips 51 and 52 by pulling outwardly thereon, (2) removing the clips 51 and 52 by sliding them out of the grooves 56 and 57 and (3) separating the panel members 14 and 15 by loosening the wing nuts 20 and 21 and then pulling the panel members apart.

Figure 7:
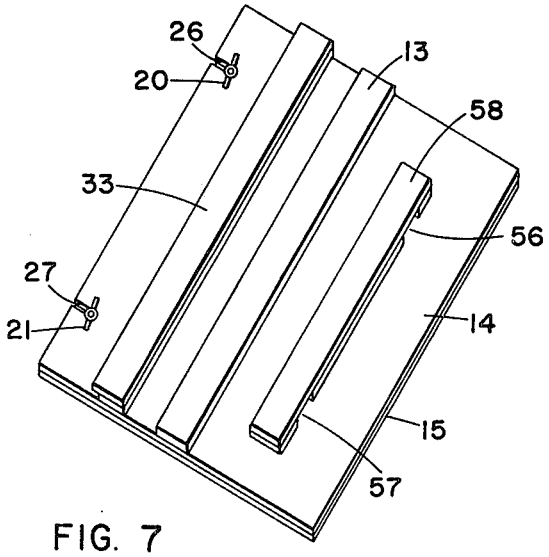
FIG. 7 is an isometric view showing the component parts of the device of the invention arranged in a package suitable for packing in a suitcase.

In order to facilitate packing and carrying the device in a conventional suitcase the component parts may be assembled into a unitary package as shown in FIG. 7 of the drawing. This is accomplished by placing the panel member 14 on top of the panel member 15 with the bottom of panel member 14 up and the slots 26 and 27 disposed to receive the bolts 18 and 19. The slots 26 and 27 are desirably long enough to permit the edges of the panel members to be aligned. The wing nuts 20 and 21 may then be tightened to hold the panel members together. The elevating member 13 may be placed between the transverse members 33 and 58 and, if desired, may be secured in position in any suitable manner as by clamps. The resulting unitary package is light in weight, sanitary, and of a size e.g. about 24 inches by 15 inches by 1½ inches, to fit into a conventional suitcase while taking up a minimum of space. The clips 51 and 52 may be placed in a corner of the suitcase.

It will thus be seen that the present invention provides a device composed of component parts which are small enough and light enough in weight to be conveniently carried in a suitcase and which are simple enough to be economically manufactured. The device, moreover, is easily and quickly assembled or disassembled without the use of tools of any kind and can be placed in operative position easily and quickly.

Although some materials have specifically mentioned as useful herein, it will be appreciated that the invention is not limited to the use of any particular materials and that any suitable material such as plywood, chip board, aluminum, and various types of compressed board can be used.

While the device of the invention has been specifically illustrated and described herein, it should be understood that the invention is not to be construed as limited by the details of such illustration and description except as the same may be included in the appended claims.

We claim as our invention:

1. A mattress elevating device composed of components easily and quickly assembled and disassembled without the use of tools, said components being suitably sized to be packed and transported in a suitcase, said device comprising panel members arranged with adjacent edge portions thereof in overlapping relationship to provide a substantially flat upper mattress supporting surface, means releasably securing the panel members together in said overlapping relationship, means secured to one of said panel members for preventing movement of the overlapped edge portion of the other panel member outwardly away from said one member, and means releasably mounted on the bottom of one of said panel members for supporting one end of the assembled panel members in a raised position.

2. A mattress elevating device according to claim 1 wherein the means secured to one of said panel members for preventing movement of the overlapped edge portion of the other panel member outwardly away from said one panel member includes a projecting portion which overlies the overlapped edge portion of the other panel member.

3. A mattress elevating device in accordance with claim 2 wherein said means and projecting portion thereof extend across said one panel member forming in conjunction therewith an elongated groove for receiving the overlapped edge portion of said other panel member to limit overlapping movement thereof and to hold it against movement outwardly away from said one panel member.

4. A mattress elevating device in accordance with claim 3 wherein said releasable securing means comprises bolts slidably mounted in openings in an overlapped portion of said other panel member, said one panel member being provided with slots extending inwardly from the edge of the overlapping portion of said member for slidably receiving said bolts when the panel members are slidably moved into overlapping relationship, and wing nuts for said bolts adapted to be turned by hand to secure the panel members together in overlapping relationship.

5. A mattress elevating device in accordance with claim 1 wherein the means for supporting one end of the assembled panel members in raised position comprises an elongated member slidably positioned in spaced clips releasably mounted on one of said panel members.

6. A mattress elevating device in accordance with claim 5 wherein each of said clips comprise a base portion and spaced arms for slidably receiving said elongated member and frictionally holding it in position, and means secured to one of said panels and provided with slots for slidably receiving the base portions of said clips.

7. A mattress elevating device in accordance with claim 6 wherein said elongated member comprises a substantially rectangular strip.

8. A mattress elevating device in accordance with claim 6 wherein said elongated member is adjustable to different widths to provide for raising the assembled panel members to different heights.

9. A mattress elevating device in accordance with claim 2 wherein the means for supporting one end of the assembled panel members in raised position comprises means secured to said one panel member and provided with slots, clips provided with base portions slidably mounted in said slots and spaced arms extending substantially at right angles to said base portions, and an elongated strip slidably mounted in said arms.

* * * * *